US008479710B2

(12) United States Patent
Davis

(10) Patent No.: US 8,479,710 B2
(45) Date of Patent: Jul. 9, 2013

(54) INJECTOR TO FUEL RAIL COUPLING STRUCTURE FOR HIGH PRESSURE DIRECT INJECTION ENGINES

(75) Inventor: G. Marc Davis, Chesapeake, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 687 days.

(21) Appl. No.: 12/775,526

(22) Filed: May 7, 2010

(65) Prior Publication Data

US 2011/0271934 A1 Nov. 10, 2011

(51) Int. Cl.
*F02M 61/14* (2006.01)

(52) U.S. Cl.
USPC ..... 123/470

(58) Field of Classification Search
USPC ..... 123/470
See application file for complete search history.

(56) References Cited

U.S. PATENT DOCUMENTS

| | | | | |
|---|---|---|---|---|
| 5,035,224 | A * | 7/1991 | Hornby et al. | 123/470 |
| 5,803,052 | A * | 9/1998 | Lorraine et al. | 123/470 |
| 5,970,953 | A * | 10/1999 | Lorraine et al. | 123/470 |
| 6,053,149 | A * | 4/2000 | Lorraine | 123/470 |
| 6,481,420 | B1 * | 11/2002 | Panasuk et al. | 123/470 |
| 6,668,803 | B1 * | 12/2003 | McClean et al. | 123/470 |
| 6,748,925 | B1 * | 6/2004 | De Vulpillieres et al. | 123/470 |
| 7,556,022 | B1 * | 7/2009 | Doherty et al. | 123/470 |
| 7,798,127 | B2 * | 9/2010 | Notaro et al. | 123/470 |
| 7,856,962 | B2 * | 12/2010 | Harvey et al. | 123/470 |
| 8,074,624 | B2 * | 12/2011 | Hohkita et al. | 123/456 |
| 8,313,125 | B2 * | 11/2012 | Giorgetti et al. | 285/305 |
| 2004/0237939 | A1 * | 12/2004 | Kondo et al. | 123/470 |
| 2009/0173317 | A1 | 7/2009 | Doherty et al. | |
| 2010/0012093 | A1 * | 1/2010 | Pepperine et al. | 123/470 |

FOREIGN PATENT DOCUMENTS

EP 2112367 A1 10/2009

* cited by examiner

*Primary Examiner* — Thomas Moulis

(57) ABSTRACT

Coupling structure (10) for coupling a fuel injector to a fuel rail (16) includes a fuel injector receiving cup (14) having an outer wall (22) and an interior space (24). The cup includes slot structure (26, 28) through the outer wall. Clip structure (30, 32) has a base (31) and a wall (40) extending transversely from the base. The base is received in the slot structure and extends into the interior space so that a portion of the base engages the fuel injector to limit movement thereof both axially and radially with respect to the receiving cup, with the wall being disposed adjacent to a portion of the outer wall of the receiving cup. A retainer (41) engages the wall of the clip structure to secure the clip structure to the receiving cup.

20 Claims, 3 Drawing Sheets

INJECTOR TO FUEL RAIL COUPLING STRUCTURE FOR HIGH PRESSURE DIRECT INJECTION ENGINES

FIELD

The invention relates to fuel supply systems and, more particularly, to an arrangement for coupling a fuel injector to a fuel rail in a high pressure direct injection engine.

BACKGROUND

In conventional direct injection fuel systems there is an issue of transmission of noise through contact, intended or unintended, between the fuel system components and the engine. In order to eliminate noise transmission, one solution is to isolate the components from the engine mechanically, such as for example, by the use of springs or elastomeric mounts. Regarding fuel injectors as the components, this type of isolation poses a challenge in that the injectors must be connected and secured directly to a fuel rail injector cup in order to suspend the injector and not allow mechanical contact with engine components. A typical way of attaching the injectors to the injector cup is by the use of thin gauge metal stamped and folded clips. However, forces generated by the high fuel pressure are greater than the ability of the aforementioned clip solution to withstand. Thus, the injector may not be secured adequately to the cup by the clip which could create a noise issue or a loss of the fluid seal.

Thus, there is a need to provide an arrangement for securely attaching a fuel injector to a fuel rail that is capable of withstanding the high pressure environment.

SUMMARY

An objective of the present invention is to fulfill the need referred to above. In accordance with the principles of an embodiment, this objective is obtained by coupling structure for coupling a fuel injector to a fuel rail of a combustion engine. The coupling structure includes a fuel injector receiving cup having an outer wall and an interior space. The receiving cup includes slot structure through the outer wall such that the slot structure is surrounded by material comprising the outer wall. The receiving cup is constructed and arranged to be coupled to a fuel rail. Clip structure is provided and has a base and a wall extending transversely from the base. The base is constructed and arranged to be received in the slot structure and to extend into the interior space so that a portion of the base can engage at least a portion of a fuel injector to limit movement of fuel injector both axially and radially with respect to the receiving cup, with the wall of the clip structure being adjacent to a portion of the outer wall. A retainer is constructed and arranged to engage the wall of the clip structure to secure the clip structure to the receiving cup.

In accordance with another aspect of and embodiment, a method is provided for coupling a fuel injector to a fuel injector receiving cup coupled with a fuel rail. The method provides a fuel injector receiving cup having an outer wall and an interior space with the receiving cup including a first slot through the outer wall such that the first slot is surrounded by material comprising the outer wall. An inlet end of a fuel injector is inserted into the interior space. A base of a first clip is inserted through the first slot to extend into the interior space so that a portion of the base engages at least a portion of the fuel injector to limit movement of fuel injector both axially and radially with respect to the receiving cup, while a wall of the first clip is disposed adjacent to a portion of the outer wall of the receiving cup. The wall of the first clip is then retained with respect to the receiving cup.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

With reference to FIGS. 1-4, the assembly of coupling structure, generally indicated at 10 in accordance with an embodiment, for coupling a fuel injector 12 to an injector receiving cup 14 will be appreciated. Only an adaptor portion of the fuel injector 12 is shown in the figures. The cup 14 can be coupled, via a connection at inlet 16, to a conventional fuel rail (not shown) of the type shown in U.S. Patent Publication No. 2009/0173317A1, the content of which is hereby incorporated by reference into this specification. Thus, the cup 14 can receive fuel from a source such as a fuel tank of a vehicle. The cup 14 can be considered to be part of the fuel rail. The fuel rail and cup 14 facilitate the communication of fuel from the source to the fuel injector 12. Although only one fuel injector 12 is shown, in a typical fuel system, a plurality of fuel injectors are mounted to the fuel rail, each via an associated cup 14. The fuel rail and cup 14 can be of any material suitable for contact with fuel such as metal, for example, stainless steel or aluminum, or of thermoplastic material or a combination of metal and thermoplastic material.

Figure 1:
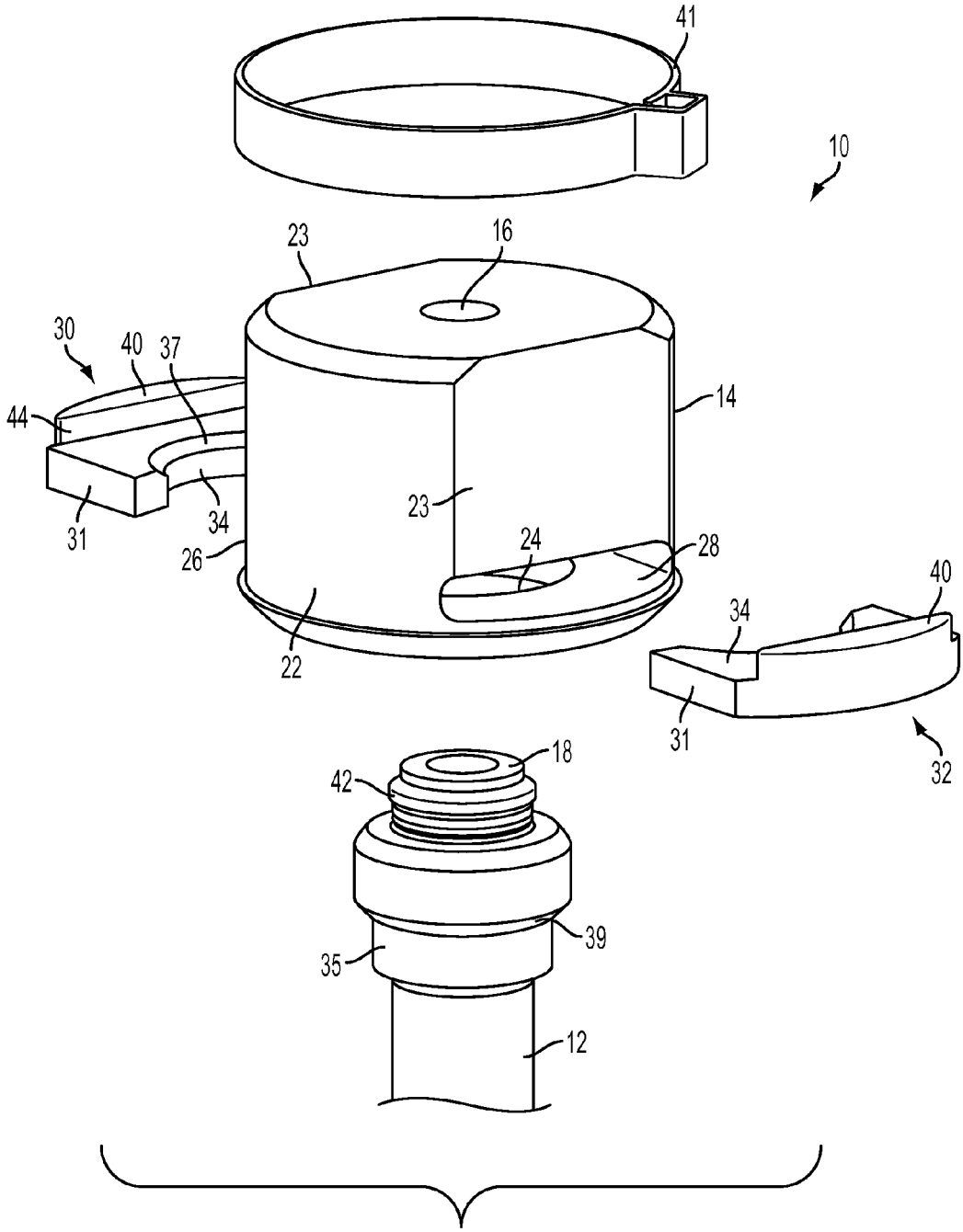
FIG. 1 is an exploded assembly view of coupling structure of an embodiment of the invention shown ready to be coupled to a fuel injector.
Figure 2:
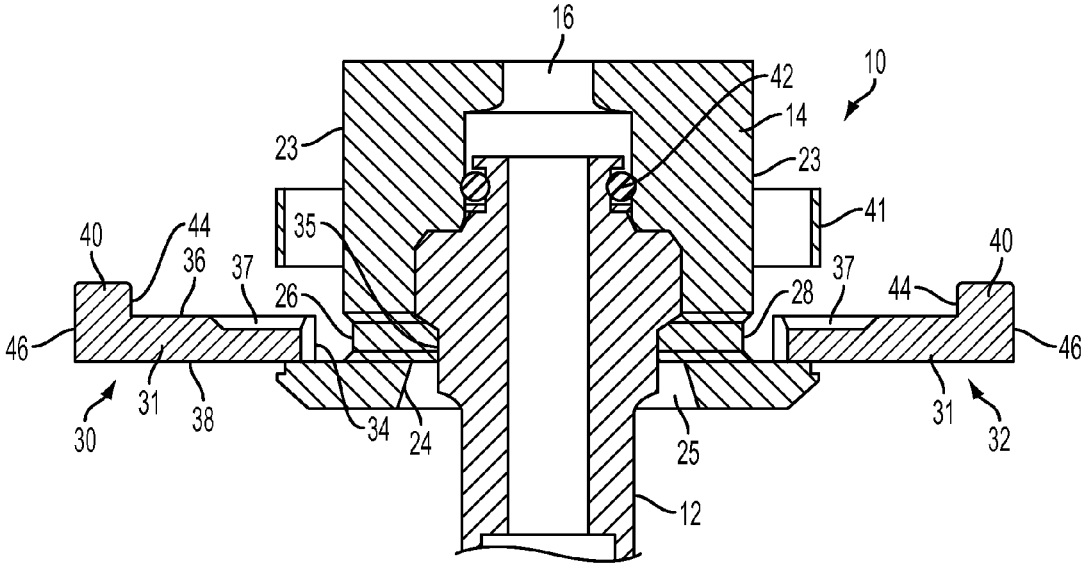
FIG. 2 is sectional view of the partially assembled coupling structure of FIG. 1, with the fuel injector received in an injector receiving cup and shown prior to insertion of clip structure and a retainer.
Figure 3:
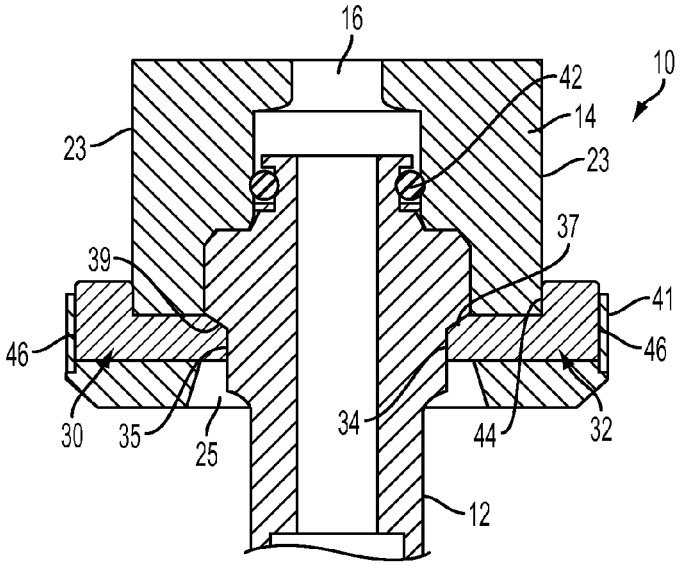
FIG. 3 is a sectional view of the coupling structure shown fully assembled to secure the fuel injector.

With reference to FIGS. 1-3, the cup 14 is constructed and arranged to receive a portion of the injector 12 including the inlet end 18 thereof to allowing fuel to communicate from the outlet of the fuel rail to the inlet 16 of the cup 14 and to the fuel injector 12. Thus, the cup 14 is operative to couple the injector 12 with the fuel rail and to allow fuel to be communicated from the fuel rail to the injector 12. The cup 14 includes an outer wall 22 having opposing planar surfaces 23, the function of which will be explained below. An opening 24 is defined at an end of the cup 14 that communicates with an interior space 25 that receives the inlet end 18 of the injector 12. The cup 14 includes slot structure that, in the embodiment, includes first and second slots 26 and 28 provided through the wall 22. The slots 26 and 28 are preferably identical and are disposed on diametrically opposed sides of the cup 14, in particular in the planar surfaces 23. Each slot extends circumferentially and is surrounded by material comprising the wall 22. One, or more than two, slots can be provided.

As best shown in FIG. 1, the coupling structure 10 includes clip structure that, in the embodiment, includes identical first and second clips, generally indicated at 30 and 32. The clips are preferably of stainless steel material and one clip is associated with each slot that is provided. Thus, clip 30 is associated with slot 26 and clip 32 is associated with slot 28. Each clip 30, 32 has a generally C-shaped base 31, having a concavely curved end 34 constructed and arranged to generally surround a neck portion 35 of the injector 12. Each base 31 preferably includes a chamfer 37 for engaging a mating chamfer 39 on the fuel injector 12, as explained more fully below. Each base 31 has a generally planar top 36 and a generally planar bottom 38. A wall 40 extends transversely with respect to the base 31 at an end opposite the concavely curved end 34.

The coupling structure 10 also includes an annular retainer 41 that is preferably of the conventional ear clamp type. The retainer 41 is preferably of stainless steel material, but can be metal or elastomer material. Alternatively, a conventional hose band clamp, spring clamp, worm gear clamp, T-bolt clamp, swage fitting, crimp fitting or that structure that can clamp over a cylindrical object can be used. The retainer 41 is initially disposed over the periphery of the cup 14 so as to be near the fuel rail end thereof (FIG. 2). The retainer 41 will be moved downwardly to secure the clips as will be explained below.

With reference to FIGS. 2 and 3, after the injector 12 is moved into the interior space 25 of the cup 14 with an O-ring 42 of the injector sealing against an internal wall of the cup 14, the clip structure is inserted into the slots 26, 28. In particular, the base 31 of each clip 30, 32 is inserted into the associated slot 26, 28 so that concavely curved end 34 partially surrounds and/or engages a portion of the neck 35 of the injector 12. As shown in FIG. 3, the curved end 34 of each base 31 engages a portion of the cylindrical neck 35 while the chamfer 37 of each base 31 engages the chamber of 39 of the injector 12. The planar top 36 and bottom 38 of the clips are trapped by the receiving cup 14.

Figure 4:
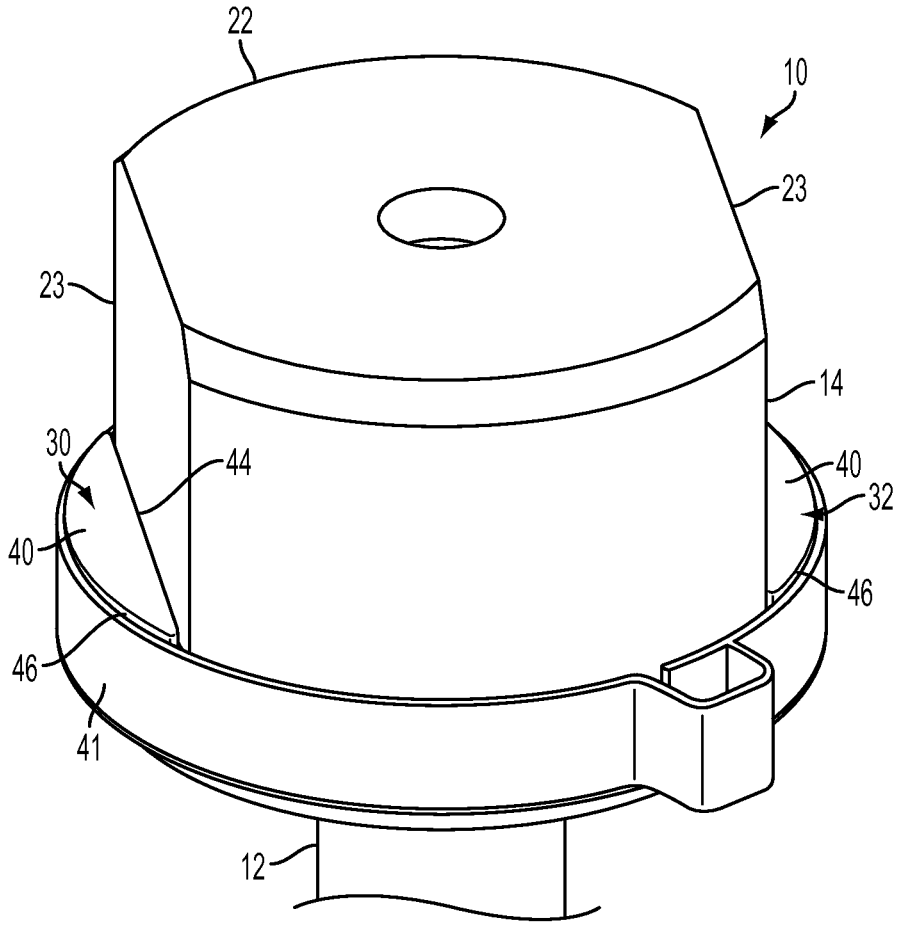
FIG. 4 is a perspective view of the coupling structure of FIG. 3.

The wall 40 of each clip 30, 32 acts as a stop and is adjacent to the outer planar surface 23 of the cup 14 to prevent the clips 30, 32 from falling completing into the interior space 25 of the cup 14. Thus, the wall 40 has an inner planar surface 44 that is adjacent to the outer planar wall 23 of the cup. To prevent the clips 30 and 32 from falling outwardly from the cup 14, as shown in FIGS. 3 and 4, the annular retainer 41 is slid downwardly so as to cover a curved outer surface 46 of each clip 30, 32. Thus, the clips 30, 32 limit axial and radially movement of the injector 12 with respect to the cup 14. The circumferentially extending retainer 41 captures the clips 30, 32 to prohibit disengagement of the clips 30, 32 from the injector 12.

Thus, the robust clips 30, 32 secured with the retainer 41 can withstand the high the forces generated by the high pressure environment and maintain the fuel injector 12 retained to the cup 14.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. Coupling structure for coupling a fuel injector to a fuel rail of a combustion engine, the coupling structure comprising:

a fuel injector receiving cup having an outer wall and an interior space, the receiving cup including slot structure through the outer wall such that the slot structure is surrounded by material comprising the outer wall, the receiving cup being constructed and arranged to be coupled to a fuel rail, clip structure having a base and a wall extending transversely from the base, the base being constructed and arranged to be received in the slot structure and to extend into the interior space so that a portion of the base can engage at least a portion of a fuel injector to limit movement of fuel injector both axially and radially with respect to the receiving cup, with the wall of the clip structure being disposed adjacent to a portion of the outer wall, and a retainer constructed and arranged to engage the wall of the clip structure to secure the clip structure to the receiving cup.

2. The coupling structure of claim 1, wherein the slot structure includes two diametrically opposed slots, each slot extending circumferentially and wherein the clip structure includes two identically configured clips, one clip being associated with each slot and each clip having the base and the wall extending there-from.

3. The coupling structure of claim 2, wherein each base has a concavely curved end defining the portion that is constructed and arranged to engage the portion of the inlet end.

4. The coupling structure of claim 3, wherein the base includes chamfer so at to engage a mating chamfer on the fuel injector.

5. The coupling structure of claim 1, wherein the base has opposing planar surfaces.

6. The coupling structure of claim 1, wherein the retainer is an annular clamp disposed over an outer surface of the wall of the clip structure and over a portion of the outer wall of the cup.

7. The coupling structure of claim 6, wherein an inner surface of the wall of the clip structure is planar and the portion of the outer wall of the cup is planar, and wherein the outer surface of the wall of the clip structured is curved.

8. The coupling structure of claim 2, wherein the retainer is an annular clamp disposed over each clip structure wall and over a portion of the outer wall of the cup.

9. The coupling structure of claim 3, in combination with the fuel injector.

10. Coupling structure for coupling a fuel injector to a fuel rail of a combustion engine, the coupling structure comprising:

a fuel injector receiving cup having an outer wall and an interior space, the receiving cup including slot structure through the outer wall such that the slot structure is surrounded by material comprising the outer wall, the receiving cup being constructed and arranged to be coupled to a fuel rail, means, having a portion constructed and arranged to extend through the slot structure, for limiting movement of a fuel injector disposed in the interior space, and means, constructed and arranged to be disposed about at least a portion of a periphery of the outer wall of the receiving cup and a portion of the means for limiting movement, for securing the means for limiting movement to the receiving cup.

11. The coupling structure of claim 10, wherein the slot structure includes two diametrically opposed slots, each slot extending circumferentially and wherein the means for limiting movement comprises first and second clips with one clip being associated with each slot, each clip having a base and a wall extending transversely from the base, the base being constructed and arranged to be received in the slot structure and to extend into the interior space so that a portion of the base can engage at least a portion of the fuel injector to limit movement of fuel injector both axially and radially with respect to the receiving cup, with the wall of the clip structure being adjacent to a portion of the outer wall of the cup.

12. The coupling structure of claim 11, wherein the means for retaining is an annular clamp disposed over each clip wall and over a portion of the periphery of the outer wall of the cup.

13. The coupling structure of claim 11, wherein each base has a concavely curved end defining the portion that is constructed and arranged to engage portion of the fuel injector.

14. The coupling structure of claim 11, wherein an inner surface of the wall of each clip is planar and the portion of the outer wall of the cup is planar, and wherein the outer surface of the wall of each clip is curved.

15. A method of coupling a fuel injector to a fuel injector receiving cup coupled with a fuel rail, the method comprising:

providing a fuel injector receiving cup having an outer wall and an interior space, the receiving cup including a first slot through the outer wall such that the first slot is surrounded by material comprising the outer wall, inserting and inlet end of a fuel injector into the interior space, inserting a base of a first clip through the first slot to extend into the interior space so that a portion of the base engages at least a portion of an of the fuel injector to limit movement of fuel injector both axially and radially with respect to the receiving cup, while ensuring that a wall of the first clip is adjacent to a portion of outer wall of the receiving cup, and retaining the wall of the clip structure with respect to the receiving cup.

16. The method of claim 15, wherein the base has a concavely curved end and the inserting step includes ensuring that the concavely curved end engages a cylindrical portion of the fuel injector.

17. The method of claim 15, wherein the retaining step includes placing an annular clamp over the clip structure wall and over a portion of the outer wall of the receiving cup.

18. The method of claim 15, wherein a second slot is provided that is diametrically opposed to the first slot and a second clip, identical to the first clip is inserted into the second slot to extend into the interior space so that a portion of the base of the second clip engages another portion of the fuel injector to further limit movement of the fuel injector both axially and radially with respect to the receiving cup, while ensuring that a wall of the second clip is adjacent to a portion of the outer wall of the receiving cup.

19. The method of claim 18, wherein the step of retaining includes placing an annular clamp over each clip wall and over the portion of the outer wall of the receiving cup.

20. The method of claim 19, further providing a chamfer on the base of the first clip and ensuing that the chamfer engages a mating chamfer on the fuel injector.

* * * * *